US005575135A

United States Patent [19]

Nordstrom

[11] Patent Number: 5,575,135

[45] Date of Patent: Nov. 19, 1996

[54] PAPER WRAPPING PROCESS AND A MACHINE FOR PERFORMING THE PAPER WRAPPING PROCESS

[75] Inventor: John E. Nordstrom, Manitowoc, Wis.

[73] Assignee: Barbara A. Nordstrom, Manitowoc, Wis.; a part interest

[21] Appl. No.: 66,407

[22] Filed: May 24, 1993

Related U.S. Application Data

[63] Continuation-in-part of Ser. No. 862,857, Apr. 3, 1992, abandoned.

[51] Int. Cl.[6] ..... B65B 11/00; B65B 51/10

[52] U.S. Cl. ..... 53/463; 53/466; 53/477; 53/228; 53/370.3; 53/371.5

[58] Field of Search ..... 156/578; 53/141, 53/228, 370.3, 375.8, 375.9, 376.2, 376.6, 383.1, 463, 466, 477, 371.5, 373.3, 377.4

[56] References Cited

U.S. PATENT DOCUMENTS

| | | | |
|---|---|---|---|
| 2,072,421 | 3/1937 | Daller | 53/373.3 X |
| 2,100,739 | 11/1937 | Gilfillan | 53/463 X |
| 2,480,501 | 8/1949 | Moore | 53/463 |
| 2,739,431 | 3/1956 | Griswold et al. | 53/375.9 X |
| 2,918,772 | 12/1959 | Bell et al. | 53/228 |
| 3,166,462 | 1/1965 | Schoder | 53/463 X |
| 3,466,838 | 9/1969 | Sorensen et al. | 53/376.6 X |
| 4,646,510 | 3/1987 | McIntyre | 53/141 X |
| 4,815,660 | 3/1989 | Boger | 156/578 X |
| 4,854,108 | 8/1989 | Cassoli | 53/228 X |
| 5,038,549 | 8/1991 | Nordstrom | 53/466 X |
| 5,046,258 | 9/1991 | Cahill et al. | 53/228 X |

*Primary Examiner*—Linda Johnson
*Attorney, Agent, or Firm*—Wheeler Kromholz & Manion

[57] ABSTRACT

A process and a machine for supplying paper to a machine for wrapping plastic wrap around workpieces. A glue is applied to the paper at a distance from the wrapping machine sufficient for the glue to dry before it is fed into the wrapping machine. Next, the wrapping machine wraps the paper around a workpiece such that the glue is located between at least two layers of the paper. Then heat sufficient to activate the glue is applied to one of the two layers of the paper. Then heat sufficient to activate the glue is applied to one of the two layers of the paper. The layers of the paper being held in place for a sufficient time to allow the glue to adhere to the layers of paper. The machine having a wrapping machine for wrapping a portion of the web around the workpieces to form a package and a glue application station for applying heat activated glue to an area of the web. The glue application station including a glue application mechanism and a feeding means for feeding the web through the glue application station, past the glue application mechanism, and into the wrapping machine. The wrapping machine including cutting means for cutting the web into the portions, a folding means for folding the web around the workpieces to form a package having folds between which the heat activated glue is located, a heating means for applying heat to the folds, and a heat sink for removing the heat from the folds to which the heat has been applied.

7 Claims, 5 Drawing Sheets

PAPER WRAPPING PROCESS AND A MACHINE FOR PERFORMING THE PAPER WRAPPING PROCESS

This application is a continuation-in-part, of application Ser. No. 07/862,857 filed Apr. 3, 1992, now abandoned.

BACKGROUND OF THE INVENTION

The present invention relates to the field of packaging paper goods. Specifically the invention is a process and a unique combination of machines for wrapping paper goods (e.g. toilet paper, napkins, and paper towels) in wrapping paper.

Wrapping paper is distinct from the standard polypropylene or plastic wrapping film that is used in the industry today. In fact the use of wrapping paper predates the use of plastic wrap by many years. Originally, all such goods were wrapped in paper but as time passed the use of wrapping paper was supplanted by the use of clear plastic wrap. Clear plastic wrap has several advantages from a sale and manufacturing point of view. It is allows the customer to see the product contained within the package and it stretches whereas wrapping paper can rupture. Also, the use of plastic wrap allows for a very clean manufacturing process in that one portion of the plastic wrap may be very easily sealed to another portion of the plastic wrap by simply heat sealing the material without the need for glue. Consequently, there is no longer any glue to get clogged in the machines or require the machine to be shut down at frequent intervals for cleaning. This means that machines may be run for longer periods of time and at greater rates of speed allowing more product to be packaged in a given period of time at a lower cost.

These benefits of plastic wrap quickly made it very popular with manufacturers and distributors. However, plastic wrap is plastic and as such it is perceived as not being friendly to the environment and in today's world that perception is a very important consideration. There is a trend in the world today to emphasize recyclability of the containers for the product as well as the product itself. Also, there is now being seen the development of laws worldwide which limit the packaging of a product to what is needed to protect and market a product. Such a law was recently passed in Germany and may be adopted by the European Community. See *The Wall Street Journal,* "German Packaging Law May Set Precedent", page B1, 17 March 1992. This law requires not only that the packaging be limited to only the amount necessary to protect and market the product but also requires companies to take back and reuse or recycle their packaging. Therefore, manufactures are now looking for packaging that are perceived to be more environmentally sound and more easily recyclable than plastic wrap. Paper wrapping is such a type of packaging.

The problem is how to use paper wrapping while still maintaining a manufacturing efficiency that is at least reasonably close to that of plastic wrap. One of the major problems that needs to be overcome is the fact that glue must be applied to the wrapping paper in order to make it hold in place once it has been wrapped around the paper goods. This leads to a manufacturing nightmare. The glue that is typically used is a dry glue of the hot melt variety. This glue is used because it solidifies or dries quickly and thus the wrapped goods may be quickly taken from the assembly line and packed. The problem is that hot melt glues first must be melted at high temperatures, usually in excess of 350° F. or approximately 175 Celsius. These high temperatures mean that it is very easy for the machine operator to be burned while performing maintenance upon the machine. Also, the glue is usually applied by the use of a roller which dips into a tank designed to hold the molten glue at a constant level. Because the glue starts to set very quickly once it is applied to the paper and because the glue is fairly viscous, strings or "angel hair" strands of glue begin to extend from the point on the wrapping paper where the glue is applied to the wheel from which the glue is applied. Movement of machine parts, products, and the air cause the glue to be spread throughout the machine and requires the machines to be frequently shut down for cleaning. This results in expensive down time that adversely affects company profits and the cost of the products sold.

The question is how to overcome these problems so that wrapping paper may be used while the speed of manufacture may kept at or near the speed of manufacture when plastic wrap is used. The inventor, by means of a very unique and simple idea, proposes the unique combination of two machines and a process that may be used in conjunction either with those machines or some other combination of similar, but not necessarily equivalent, machines which allow the use of wrapping paper while at the same time preserving the efficiencies of plastic wrap.

The inventor knows of no prior art which either discloses or teaches the invention disclosed herein.

SUMMARY OF THE INVENTION

The crux of the present invention is the realization that it is crucial to have the hot melt or other heat sealable glue set-up or solidify before it enters the wrapping machine where it could become smeared upon the rollers and other parts of the machine; i.e. so that the glue does not transfer from the wrapping paper to the machine. This is accomplished by adding an extension ahead of the shear of the wrapping machine station which acts as a cooling and drying section that allows the glue that has been applied to the paper web additional time to solidify and thus become inactive before it reaches the draw rollers of the machine. The extension also allows the hot melt glue application system to be located off of the main portion of the wrapping machine. This keeps the main machine clean from the hot melt drippage, and allows for safety and ease of accessibility when maintenance is required for either the main machine or the hot melt glue application station.

The process for applying the hot melt glue and wrapping the roll paper or other workpieces in wrapping paper uses the combination of a hot melt glue application station and a workpiece wrapping machine. The process essentially comprises:

1. A first step in which a web of wrapping paper is fed from a paper roll into the glue application station;
2. A second step in which the hot melt glue is applied to a first predetermined portion of the web in the glue application station;
3. A third step in which the glue applied to the first predetermined portion of the web is allowed to dry and solidify;
4. A fourth step in which the wrapping paper bearing the dried and solidified glue is fed into the workpiece wrapping machine;
5. A fifth step in which the wrapping paper is folded around the workpieces in a known manner and the first predetermined portion of the wrapping paper to which the glue has been applied is pressed against a second predetermined portion of the web;

6. A sixth step in which the pressed together first and second predetermined portions of the wrapping paper are heated to a temperature sufficient to activate the glue and insufficient to damage the wrapping paper and the workpieces wrapped in the wrapping paper;
7. A seventh step in which the hot melt glue is cooled while the first and second predetermined portions of the web are held together so that the first and second predetermined portions of the web adhere to each other and the workpiece is are wrapped suitably.

The process may be accomplished by the unique combination of a modified paper wrapping machine with a glue application station.

The glue application station includes a parent paper roll from which a paper web of predetermined size is normally continuously fed into the glue feeding station, glue applications devices from which heat sealable glue (supplied from a glue reservoir) is applied to predetermined surface areas of the web as the web is continuously fed through the glue application station, and a cooling or drying area in which the glue is resolidified upon the predetermined portions of the web prior to feeding the web into the modified paper wrapping machine.

The modified paper wrapping machine may be any type of paper wrapping machine known in the paper wrapping industry for the wrapping of paper products in plastic film. However, the paper wrapping machine must include heating plates or other heating means for producing heat sufficient to activate the glue between the folded layers of paper at a temperature that is insufficient to damage the products which are wrapped and the wrapping paper itself. Normally, this also requires that the means for applying the heat must act upon the areas of the wrapping paper between which the glue is located for a time sufficient to activate the glue. This is an important consideration because the wrapping paper tends not to immediately transfer the heat of the heating means and the temperatures that must be used to activate the glue are in excess of the temperatures required to safely soften the traditional plastic packaging enough to form a seal. In fact the temperatures required for wrapping paper are so much higher that if traditional plastic wrap is used in the same machine it will be destroyed, making a considerable mess and requiring that the line be shut down. Consequently, the heating requirements for the use of traditional plastic wrap are essentially different from the heating requirements of the present invention for paper wrap.

Suitable glues include hot melt glues and other heat activatable glues. The description will refer to "hot melt" glues as inclusive of other heat activatable adhesives.

After remelting the hot melt glue sufficient time must be given to allow the glue to resolidify so that it properly adheres. Because the glue will not adhere properly until it is at least partially resolidified the folded sections of the paper wrap between which the hot melt glue is located must be held in place. This may be accomplished by either having an exit conveyor of sufficient length to allow the glue to cool and resolidify or by having a shorter exit conveyor which employs heat sinks to quickly cool the hot melt glue located between the folded sections of the paper wrap. Of the last two options the latter is preferred because it allows for a smaller machine and quicker production.

These and other benefits of the present invention will be apparent to one skilled in the art from the following description.

FIG. **9*a*** is a cross-sectional view of the glue gun or applicator head showing the location and orientation of the glue and air ejection ports.

Figure 10:
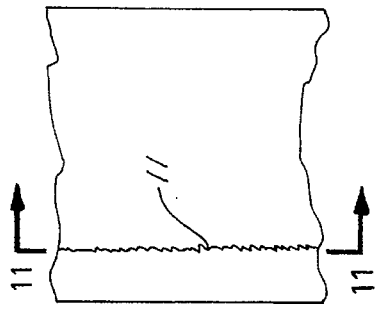

FIG. 10 is a plan view of a portion of the paper showing where a strip of glue has been applied.

Figure 11:
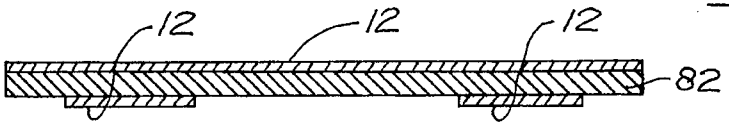

FIG. 11 is a view from line 11—11 of FIG. 10.

Figure 12:
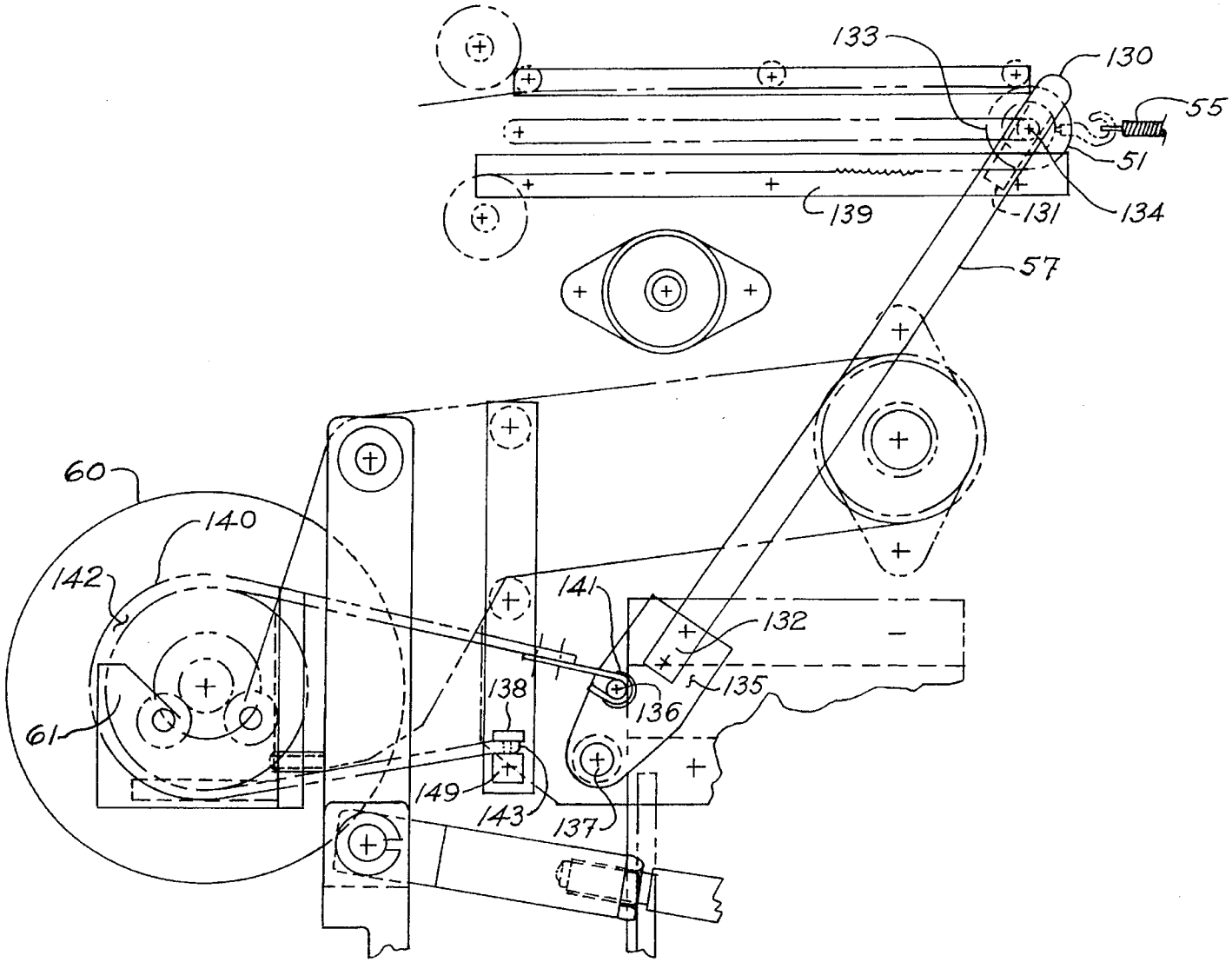

FIG. 12 is a side view showing the mechanism by which the dancer roller and the parent roll of the paper interact.

Figure 13:
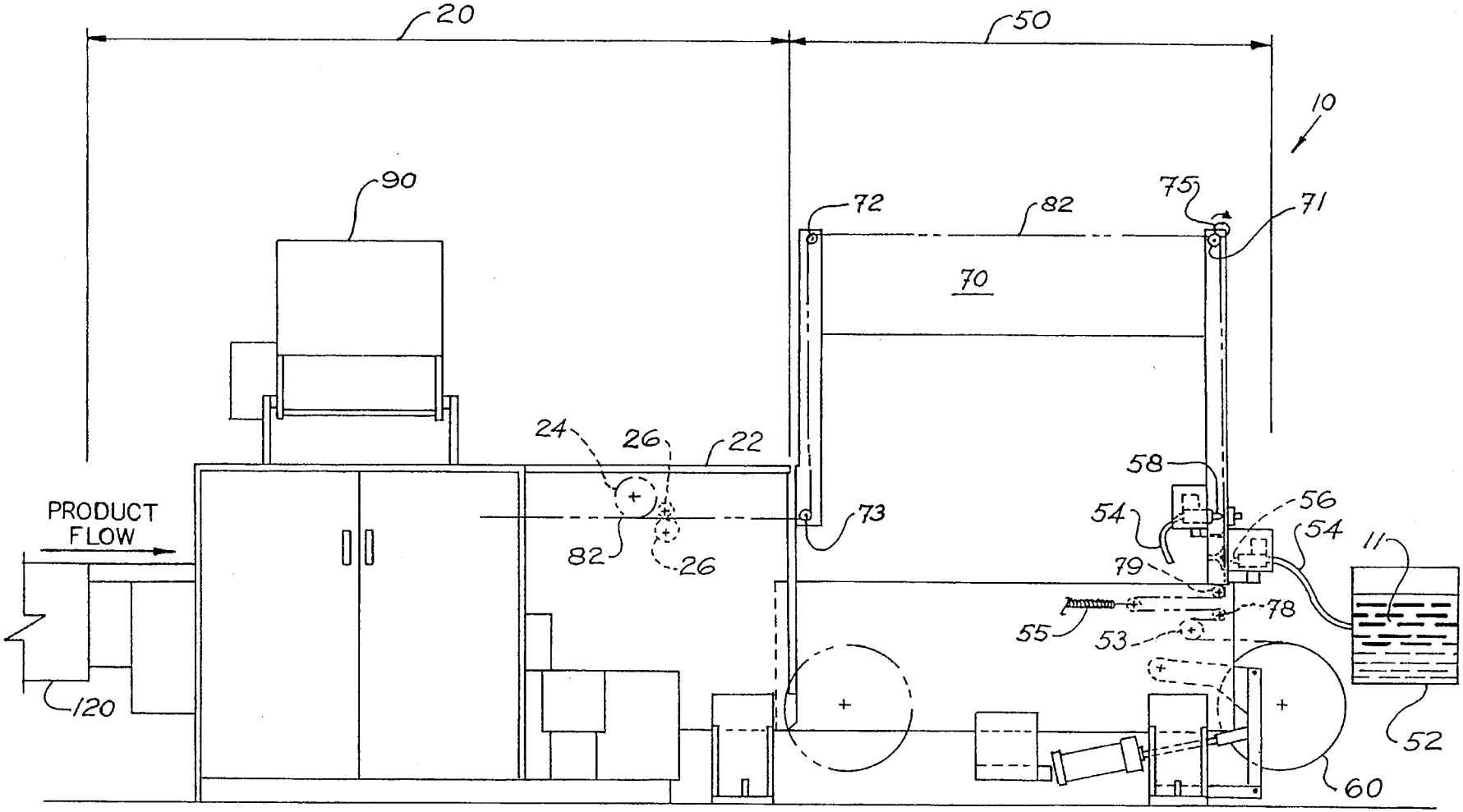

FIG. 13 is a side plan view showing the relationship of the glue application station with the modified paper wrapping machine including an alternative embodiment of the present invention showing the addition of a roller 75 for flattening the soft glue onto the paper to form a substantially thin glue line on the paper.

Figure 14:
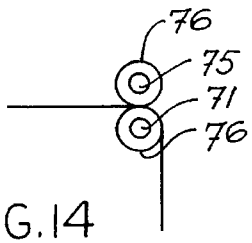

FIG. 14 is a side plan view of an alternative embodiment of the present invention showing a non-stick coating such as TEFLON brand non-stick coating applied to rollers 71 and 75.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention is a process for wrapping paper wrap 82 around paper good workpieces 30 and a glue application system machine 10 for applying the process. For purposes of simplicity the glue application system machine 10 shall be referred to as the machine 10 for the rest of this description.

Figure 1:
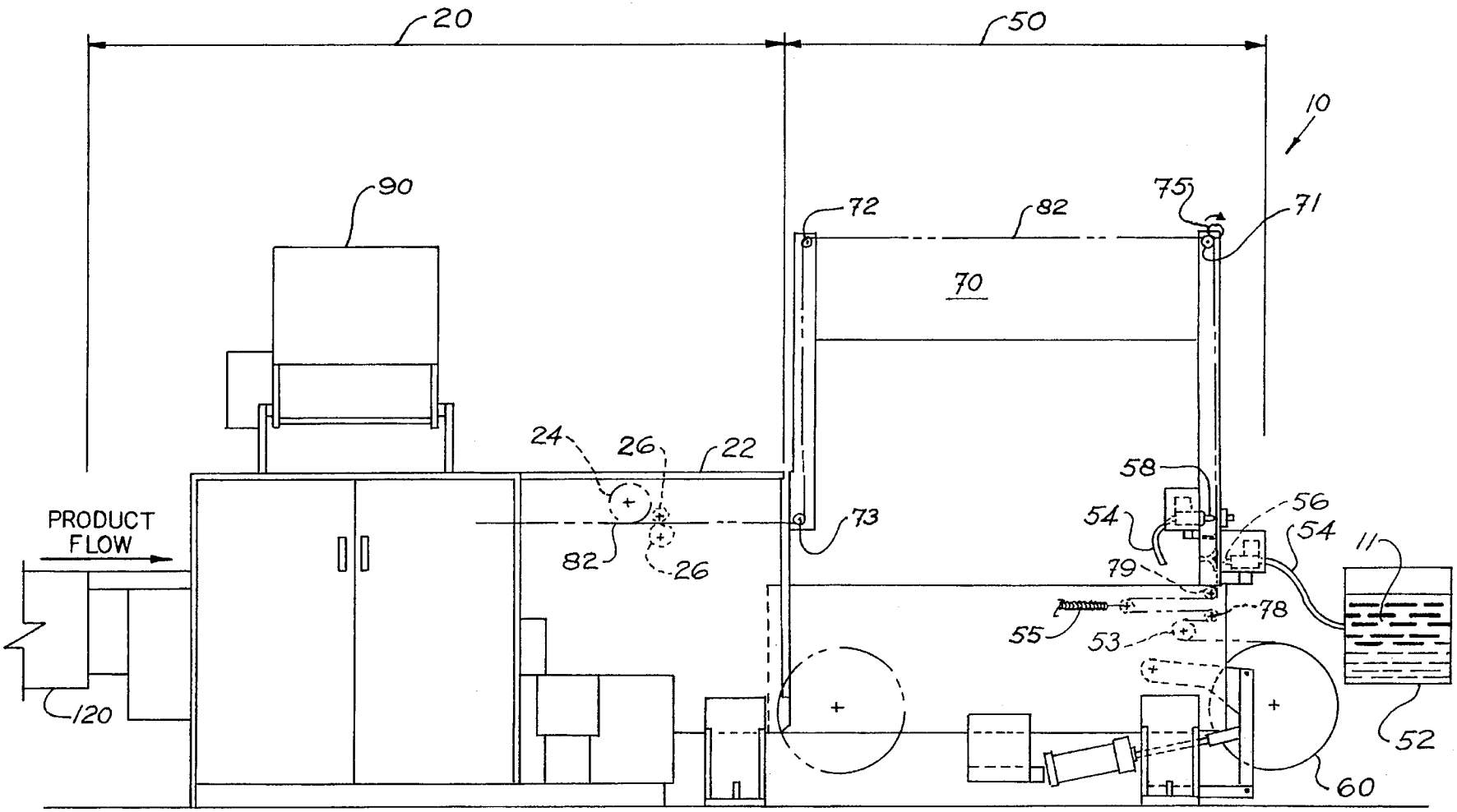
FIG. 1 is a side plan view showing the relationship of the glue application station with the modified paper wrapping machine.

Referring to FIG. 1 it may be seen that the machine 10 is comprised of two main parts: a wrapping machine station 20 and a glue application station 50.

Figure 4:
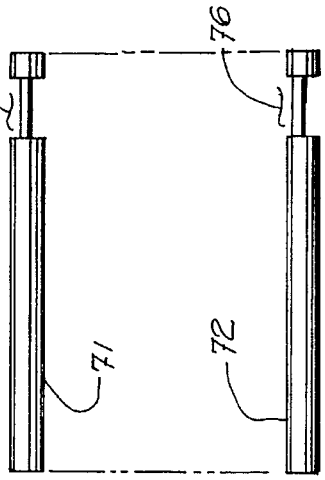
FIG. 4 is a plan view of the rollers in the cooling area of the glue application station showing the gaps in the roller surface through which pass the areas of the paper web to which glue has been applied without touching the roller surface.

The glue application station 50 includes a hot melt glue reservoir 52 in which the hot melt glue 11 is kept in a heated molten state, glue feed lines 54, end seal glue nozzles 56, bottom seal glue nozzles 58, a dancer roller 51, a booster roller 53, a spring 55, a linkage 57, a leather belt 59, a parent paper roll 60, a glue drying area 70, and a series of rollers 71–73. Rollers 71 and 72 have gaps 75 and 76 respectively which are shown in FIG. 4. The spring 55, linkage 57, and leather belt 59 all operate in conjunction with the dancer roller 51 and may be seen in FIG. 12. Referring back to FIG. 1, the paper web 82 is fed into the glue application station 50 from the parent roll 60. The paper web 82 is then fed over the booster roller 53, which is a powered roller designed to aid in feeding the paper 82 from the parent roll 60 through the glue application station 50, to idler roller 78 and then over the dancer roller 51 from which it is fed over another idler roller 79 past the glue nozzles 56 and 58 and then over the rollers 71–73 and into the wrapping machine station 20.

Referring to FIG. 12 the full mechanism by which the dancer roller 51 operates may be seen. The dancer roller 51 is connected to a spring 55 and a linkage 57 having a top end 130 and a bottom end 132. The top end 130 of the linkage 57 is slidably connected to the tongue end 134 of the dancer roller 51 at the yoke slot 131 (shown in phantom). The bottom end 132 of the linkage 57 is connected to a boot 135 that is pivotally connected to a pivot connection 137. The boot 135 has a fixed attachment point 136 to which one end 141 of a brake belt 140 having a middle portion 142 wrapped around the end of the roller 61 to which the parent roll 60 is mounted and a second end 143 which is attached to a fixed block 149 by the bolt 138.

The tongue end 134 of the dancer roller 51 passes through and rides upon the center of a pinion gear 133 which rides upon a rack 139. Thus the movement of the dancer roller 51 is linear. This linear motion is made possible by the fact that the tongue end 134 of the dancer roller 51 is slidably connected to the yoke slot 131 so that the tongue end 134 rides up and down in the yoke slot 131 as the dancer roller 51 moves back and forth.

Referring to both FIGS. 1 and 12, the dancer roller 51 operates as follows: When the machine 10 is turned on the parent roll 60 turns at the urging of the booster roller 53. This causes tension upon the dancer roller 51 sufficient to overcome the pulling force of the spring 55 so that the dancer roller 51 is moved toward the idler rollers 78–79. This cause the linkage 57 to act as a lever which swings the boot 135 on its pivot toward the parent roller 60 thereby loosing the brake belt 140. When the machine 10 is turned off the opposite happens, the tension of the spring 55 pulls the dancer roller 51 away from the idler rollers 78–79 and thereby accomplishes two things: First, the brake belt 140 is tightened and thus the parent roller 60 is brought to a stop and second the dancer roller 51 picks up the excess paper 82 that continues to roll off the parent roller 60 as the parent roll 60 is brought to a gradual stop.

Figure 9A:
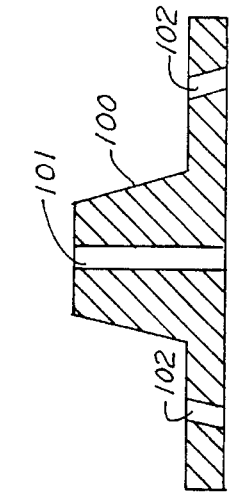
FIG. 9 is a perspective view of the glue gun or applicator head showing the location of glue and air ejection.
Figure 9:
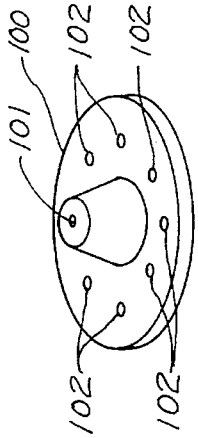
Figure 8:
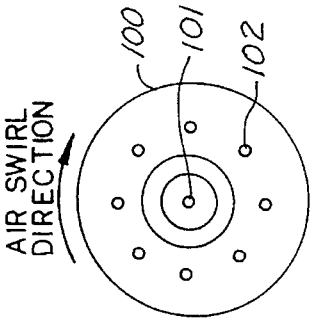
FIG. 8 is a top plan view of the glue gun or applicator head showing the location of glue and air ejection.

Referring back to FIG. 1, the hot melt glue 11 is preferably kept in the reservoir 52 at a temperature in excess of 350° F. to 175° Celsius. This ensures that the glue 11 will flow freely. The glue 11 is pumped by a known means for pumping hot melt glue 13 from the reservoir 52 to through the glue feed lines 54 to the end glue seal nozzles 56 and the bottom seal glue nozzles 58. The nozzles 56 and 58 both have the same type of applicator head 100 as may be seen in FIGS. 8 and 9. The timing of the application of the glue 11 is also done by a known means which uses the speed and ratio of roller sizes to measure the rate at which the paper 82 moves past the glue nozzles 56 and 58.

While different types of applicator heads may be used it has been found that the type of applicator head 100 disclosed herein appears to presently work best because as the glue 11 is ejected from the center opening 101 the concentric air jet openings 102 are angled to provide a swirling blast of air which picks up the ejected liquid hot melt glue 11 and swirls it onto predetermined portions of the paper 82. Please see FIGS. 8, 9, and 9*a*.

The chief advantage of this is that the glue 11 may be directly applied in a very thin layer 12 without requiring any extra work such as using a spatula to flatten out a bead of the glue 11. See generally FIGS. 1, 10, and 11. The other advantage to applying the glue 11 in a thin layer 12 is that the glue 11 dries very quickly. This means that depending upon the thickness of the layer 12 of glue 11 applied and the rate at which the glue 11 dries that it might be possible to apply the glue in a manner that allows it to solidify almost immediately. Consequently, the space devoted to allowing the glue 11 to dry or solidify may be greatly reduced or eliminated entirely.

Additionally, the gaps 75 and 76, shown in FIG. 4, are provided to allow predetermined portions 81 of the wrapping paper 82, to which the glue 11 has been applied, to avoid contact with the rollers 71 and 72. This is to avoid having the glue 11, which may not be completely solidified and dried at the time the paper 82 passes over the rollers 71 and 72, from being transferred to the rollers 71 and 72 thereby necessitating shut down of the machine 10 to clean the rollers 71 and 72. These gaps 75 and 76 may be eliminated if a quick drying glue 11 or a thin layer 12, sufficient to work and to dry very fast, or both are applied to the paper 82.

The gaps 75 and 76 of the rollers 71 and 72 are not necessary to practice the present invention and the machine 10 and the process of this invention may be such that the process applies the glue 11 in a thin layer 12 sufficient to be at least substantially, if not totally, dry before contact with the rollers 71 and 72; and totally dry before entering the wrapping machine station 20. This prevents the undesired transfer of glue 11 to the parts of the wrapping machine station 20, e.g. the rollers 26 that act to advance the wrapping paper 82, that come into contact with the wrapping paper 82. Further, any glue 11 that is not sufficiently dry will transfer to the rollers 71 and 72. As FIG. 1 shows these rollers 71 and 72 are located in the glue drying section 70 and are substantially separate from the wrapping machine station 20 so that they are easily and safely accessible to any worker and easily be cleaned if need be without having to shut the machine 10 down for a significant period of time. The rollers 71 and 72 could even be quickly replaced with substitute rollers so that operation of the machine 10 could continue uninterrupted while the rollers 71 and 72 were cleaned. Accordingly, no rollers of any special design or feature are necessary for use with the present invention.

Thus, the process and machine 10 of the present invention work so that the glue 11 is applied to a first predetermined portion of the wrapping paper 82 wherein the glue 11 is allowed to dry in the glue drying section 70 of the machine 10 and the wrapping paper 82 passes through the glue drying section 70 over the rollers 71 and 72 without substantial transference of the glue 11 from the wrapping paper to the rollers 71 and 72. The wrapping paper 82, having the dried glue 11, then continuing on into the wrapping machine station 20 where it is cut to a predetermined length, and there can be substantial contact between the web and the rollers of the wrapping machine station 20 without transference of the glue 11 to the wrapping machine station 20.

One potential drawback to this possible alteration in the structure and process of the present invention is that such quick drying or solidifying glues may not be easily digestible or recyclable and thus would be of less value because of the current trend toward recyclable packaging. However, the important point is that regardless of whether or not the glue 11 used is recyclable (i.e. digestible in a digester) it may still be used even though that use in the process and structure of the present invention may or may not be commercially viable.

Alternatively, to accomplish the process of the present invention the glue 11 may be applied by the manufacturer of the wrapping paper 82 so that when the parent roll 80 is delivered to the packaging plant or area the glue 11 will already be on the paper 82 and in solid form; this is similar to the way envelopes are manufactured except that envelopes generally do not use hot melt glue.

Unfortunately this alternative presents several problems. First, wrapping paper 82 usually comes on a large roll (the parent roll 60 disclosed herein) having a uniform shape. The shape is uniform because the paper 82 has a substantially uniform thickness; e.g. 2 mils. The addition of glue 11 to the paper 82 eliminates this uniform thickness where the glue 11 is applied such that when the paper 82 is rolled up, rather than having a uniform shape, it would tend to bulge where the glue 11 has been applied. This means that it may not be easy to feed paper 82 from the parent roll 60 into the wrapping machine station 20. Second, because paper 82, unlike plastic, does not stretch but ruptures the paper 82 could have a tendency to tear on the parent roll 60.

Still referring to FIG. 1, the portion of the paper web 82 to which the glue 11 has now been applied passes over the rollers 71–73 of the glue drying area 70. This ensures that the glue 11 is in fact completely dry and solid. Once the glue 11 is completely dry and solid it is fed into the wrapping machine station 20.

Again referring to FIG. 1 the wrapping machine station 20 may be any wrapping machine for wrapping plastic film or wrap around paper goods. Accordingly, for the purposes of illustration the "Stacking Packaging Machine" disclosed in U.S. Pat. No. 5,038,549 is incorporated by reference into this specification.

As may be seen in FIG. 1 a standard wrapping machine 20 having an overhead conveyor 90, a roll infeed conveyor 120, and a shear 22 which includes draw rollers 26 and a rotary cutting shear 24 for cutting the paper 82 into predetermined sizes is used. The paper 82 is wrapped around the paper good workpieces 30 in the normal manner, however, in order to properly seal the folded portions of the paper 82 to each other the wrapping machine station 20 must be modified.

Figure 2:
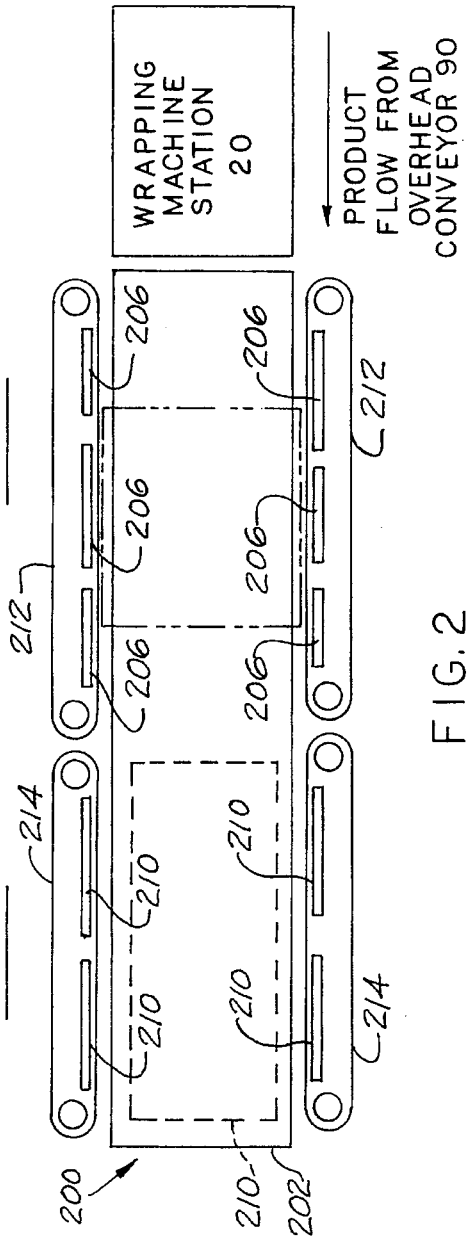
FIG. 2 is a top plan view of the exit conveyor showing the location of the heating plates and the heat sinks.
Figure 3:
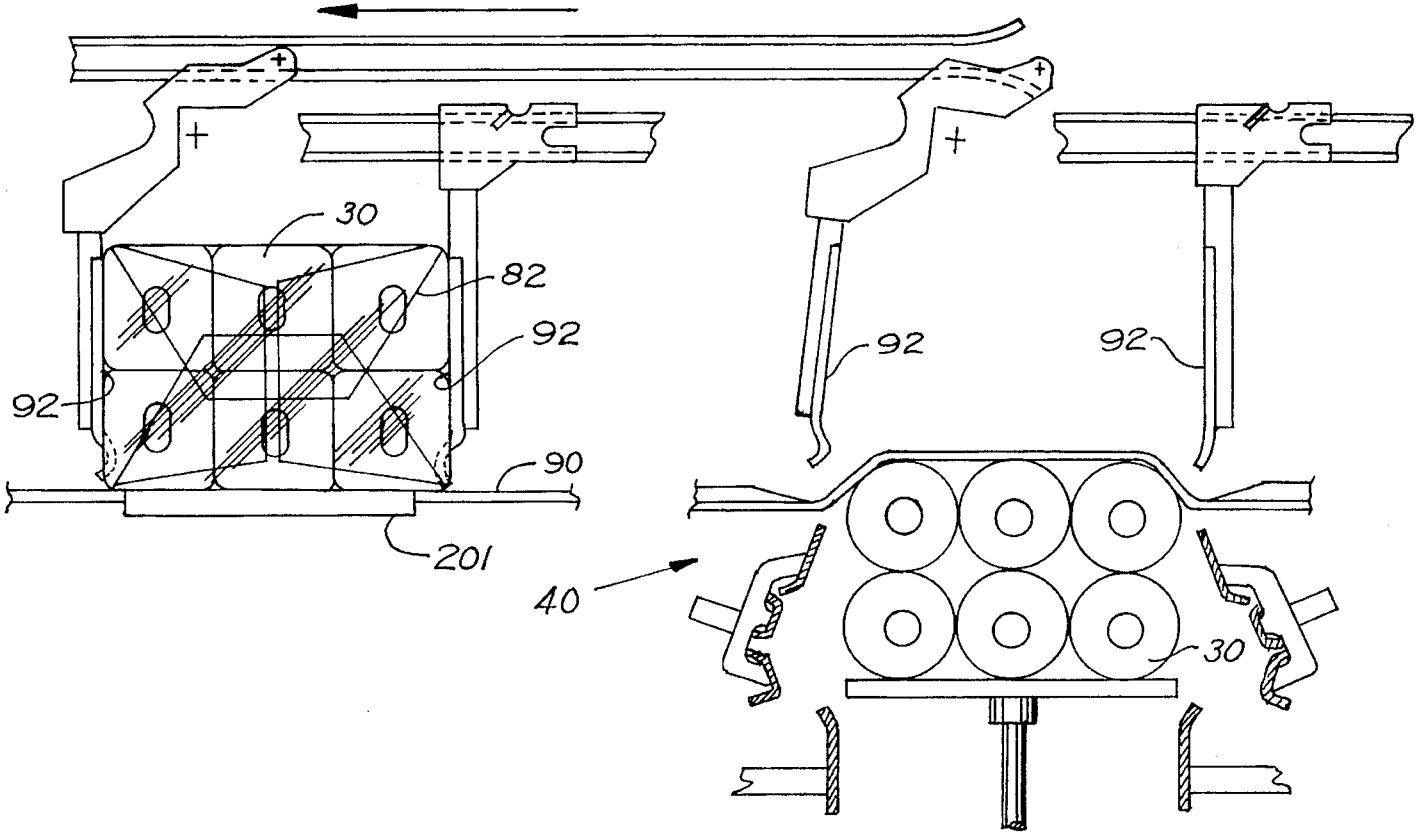
FIG. 3 is a side elevational view showing the location of the heat plate inside the wrapping machine at the point at which the seam seal is made.

Referring to FIGS. 2 and 3, heating plates 201, 206, and heat sinks 210 must be added to the structure of the wrapping machine station 20. Referring to FIG. 3 it may be seen that heating plate 201 is positioned on the overhead conveyor 90 such that the bottom seam 151 of the package 150 (See FIGS. 5–7) is passed over it at a speed sufficient to allow adequate time for remelting of the hot melt glue 11 located between the folds of the wrapping paper 82 that has been folded around the paper goods 30.

The package 150 then continues down and out of the overhead conveyor 90 to the output conveyor system 200, as shown in FIG. 2, where the heat plates 206 contained in side conveyors 212 remelt the hot melt glue 11 contained in the end seals 152. The package 150 then next passes over and by the heat sinks 210 contained in the main output conveyor belt 202 and the side belts 214 so that the glue 11 is resolidified and the package 150 may be immediately packaged for shipping.

Alternatively the present invention 10 may be modified as shown in FIGS. 13 and 14.

FIG. 13 shows the same view as in FIG. 1 except that a roller 75 has been added. It has been found that the glue 11 applied to the paper 82 remains in a somewhat plastic or malleable state at this point in the process where rollers 75 and 71 are located. Rollers 75 and 71 are positioned to apply sufficient pressure to the still malleable glue 11 in order to substantially flatten the glue 11 against the paper 82. This flattening of the glue 11 creates a substantially thinner layer of glue 11. It has been found helpful in increasing the efficiency of the process and the machine of the present invention 10 to have a thinner layer of glue 11.

Figure 7:
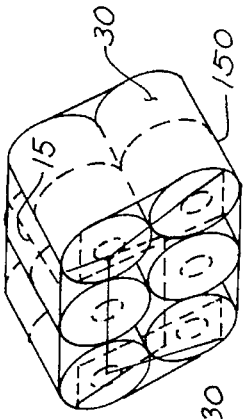
FIG. 7 is an elevational view showing 12 pack package of paper goods wrapped in paper and the location of both the end seals and the seam seals.
Figure 6:
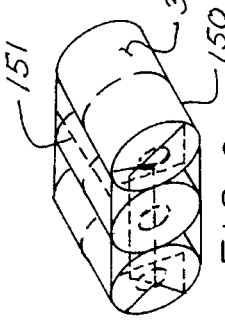
FIG. 6 is an elevational view showing 6 pack package of paper goods wrapped in paper and the location of both the end seals and the seam seals.
Figure 5:
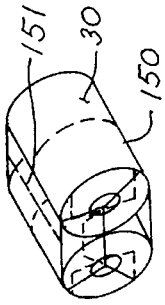
FIG. 5 is an elevational view showing 4 pack package of paper goods wrapped in paper and the location of both the end seals and the seam seals.

When the paper 82 is wrapped around the work pieces or paper goods 30 it is then transferred to the portion of the machine 20 shown in FIG. 2 where the heat plates 206 remelt the hot melt glue 11 contained in the end seals 152 and the heating plate 201 melts the glue 11 in the bottom seam 151 of the package 150 (see FIGS. 5–7). The thinner the layer of the glue 11 the quicker it will respond to the heating and remelt. This increases the speed at which the machine 20 can be run. Accordingly the machine 20 may be run at speeds that meet or exceed the speeds at which a standard paper wrapping machine using plastic film will run.

It should be noted that the roller 75 is added to the present invention because the glue 11 is applied to both sides of the paper 82. Obviously, if glue 11 were applied to only one side of the paper 82 only one roller would be necessary on that particular side to flatten the glue 11.

Additionally, referring to FIG. 14, it may be seen that the rollers 71 and 75 that have the initial contact with the glue 11 when it is still in a plastic or malleable state may be further improved with the addition of a non-stick coating 76, such as TEFLON non-stick coating. In typical operation the rollers 71–73 and 75 are in fact smooth surfaces of polished aluminum. Typically the glue 11 will not stick to these smooth polished surfaces. This is in part due to the fact that the metallic surface of the rollers 71–73, 75 is not porous whereas the paper 82 is a porous and rough surface with respect to the glue 11 and therefore the glue 11 will adhere in preference to the paper 82 over the rollers 71–73, 75. However, should the glue 11 be in an extremely soft or sticky state the use of a TEFLON type surface on the rollers will allow the rollers to still flatten the glue 11 without an undesirable build up of glue 11 on the rollers 71 or 75 or the creation of angel hair type strands of the glue 11.

The foregoing is considered as illustrative only of the principles of the invention. Furthermore, since numerous modifications and changes will readily occur to those skilled in the art, it is not desired to limit the invention to the exact construction and operation shown and described.

What is claimed is:

1. A process for using wrapping paper, having a glue applied to it, to completely wrap paper goods using the combination of a glue application station having a drying section, including a roller means for supporting the wrapping paper as it passes through the drying section, for allowing the glue applied to the wrapping paper to dry and a paper product wrapping machine having an advancement means for advancing the wrapping paper through the paper product wrapping machine, the process comprising:

a first step in which a web of wrapping paper is fed from a means for supplying wrapping paper into the glue application station;

a second step in which the glue is applied, in the glue application station by spraying the glue from a spray means for spraying the glue, to a first predetermined portion of the web;

a third step in which the glue applied to the first predetermined portion of the web is allowed to dry in the drying section and the web continues through the drying section over the rolling means without substantial transference of the glue from the web to the rolling means;

a fourth step in which the wrapping paper, having the dried glue on the predetermined portion of the web, is fed into the paper product wrapping machine, cut to a predetermined length, and there is substantial contact between the web and the advancement means without transference of the glue to the advancement means;

a fifth step in which the wrapping paper is completely folded around the paper goods and the first predetermined portion of the wrapping paper to which the glue has been applied is pressed against a second predetermined portion of the web;

a sixth step in which the pressed together first and second predetermined portions of the wrapping paper are heated to a temperature sufficient to activate the glue and insufficient to damage the wrapping paper; the paper goods being completely wrapped in the wrapping paper;

a seventh step in which the glue is resolidified while the first and second predetermined portions of the web are held together;

whereby the first and second predetermined portions of the web adhere to each other and the paper goods are completely wrapped.

2. The process of claim 1 in which the advancement means are rollers.

3. The process of claim 1 in which the spraying means includes an applicator head designed to apply the glue in a predetermined pattern to the paper wrapping material.

4. The process of claim 4 in which the glue is sprayed onto the wrapping paper material by the spray means through the applicator head so that it is applied to the wrapping paper material in a swirl pattern.

5. The process of claim 1 in which the glue has a minimum melting temperature of 175 Celsius.

6. The process of claim 1 further including an intermediate step between the third and fourth steps in which the rolling means substantially flattens the glue onto the web.

7. A machine for wrapping and sealing a predetermined portion of a web of paper around paper goods, the machine comprising:

a wrapping machine means for wrapping the predetermined portion of the web completely around the paper goods go form a package around the paper goods; and a glue application station for applying heat activated glue to a predetermined area of the web;

the glue application station including a spraying means for spraying heat activated glue and a feeding mechanism for feeding the web through the glue application station, past the spraying means, and into the wrapping machine means;

the wrapping machine means including cutting means for cutting the web into the predetermined portions, a folding means for folding the predetermined portion of the web completely around the paper goods to form a package having folds between which the heat activated glue is located at a predetermined position, a heating means for applying heat to the folds between which the heat activated glue is located, and a heat sink means for removing the heat from the folds to which the heat has been applied;

the glue application station being sufficiently separate from but connected to the wrapping machine means so that the glue applied to the web by the spray means is completely dry prior to entering the wrapping machine means; the web passing through the wrapping machine without transference of the glue to the wrapping machine;

the feeding mechanism having a nonstick surface material.

* * * * *